US005973106A

United States Patent [19]

Shiota et al.

[11] Patent Number: 5,973,106

[45] Date of Patent: Oct. 26, 1999

[54] ACRYLONITRILE POLYMER COMPOSITIONS, METHOD FOR PRODUCING THE COMPOSITIONS, AND METHOD FOR PRODUCING SHAPED ARTICLES FROM THE COMPOSITIONS

[75] Inventors: Hirotaka Shiota, Okayama; Ryosuke Nishida, Okayama-ken; Takahisa Kida, Okayama; Noriyuki Kohara, Okayama; Yoshihiro Watanabe, Okayama; Ryuichi Kasahara, Okayama, all of Japan

[73] Assignee: Japan Exlan Company Limited, Osaka, Japan

[21] Appl. No.: 08/909,850

[22] Filed: Aug. 12, 1997

Related U.S. Application Data

[62] Division of application No. 08/627,099, Apr. 3, 1996, abandoned.

[30] Foreign Application Priority Data

Apr. 24, 1995 [JP] Japan ..... 124296

[51] Int. Cl.[6] ..... C08L 23/26

[52] U.S. Cl. ..... 528/480; 528/481; 528/491; 526/935

[58] Field of Search ..... 528/480, 481, 528/491; 426/935

[56] References Cited

U.S. PATENT DOCUMENTS

| | | | |
|---|---|---|---|
| 3,847,885 | 11/1974 | Peeso, Jr. . | |
| 3,940,405 | 2/1976 | Serad . | |
| 4,221,878 | 9/1980 | Tokas | 525/1 |
| 4,228,119 | 10/1980 | Gomez et al. | 264/211 |
| 4,238,441 | 12/1980 | Cramer | 264/206 |
| 4,255,307 | 3/1981 | Miller | 528/487 |
| 4,365,027 | 12/1982 | Senyek et al. | 523/332 |
| 4,396,740 | 8/1983 | Wozny | 524/827 |
| 4,461,739 | 7/1984 | Young et al. | 264/176 F |

FOREIGN PATENT DOCUMENTS

| | | |
|---|---|---|
| 0223199 | 5/1987 | European Pat. Off. . |
| 0355764 | 2/1990 | European Pat. Off. . |

OTHER PUBLICATIONS

Bruson, *Organic Reaction*, "Cyanoethylation", Chapter 2, 1957, pp. 79–135.

*Primary Examiner*—Jeffrey C. Mullis
*Attorney, Agent, or Firm*—Wenderoth, Lind & Ponack, L.L.P.

[57] ABSTRACT

Disclosed are a hot-melting acrylonitrile (AN) polymer composition comprising a non-volatile component modified from AN alone or a AN monomer composition through chemical reaction, an AN polymer and water, a method for producing the composition, and a method for producing a shaped article of AN polymer by melting the composition under heat followed by shaping the melt. The composition and the shaped article do not contain toxic AN and AN monomer mixture.

1 Claim, No Drawings

ACRYLONITRILE POLYMER COMPOSITIONS, METHOD FOR PRODUCING THE COMPOSITIONS, AND METHOD FOR PRODUCING SHAPED ARTICLES FROM THE COMPOSITIONS

This is a divisional application of Ser. No. 08/627,099 filed Apr. 3, 1996 now abandoned.

FIELD OF THE INVENTION

The present invention relates to acrylonitrile (hereinafter referred to as AN) polymer compositions, a method for producing the compositions and a method for producing shaped articles from the compositions. In particular, the invention relates to AN polymer compositions, a method for producing the compositions and a method for producing shaped articles from the compositions, which are characterized in that the shaped articles do not contain, immediately after the production thereof, the non-reacted monomer or monomer mixture or the monomer or monomer mixture used as plasticizer.

BACKGROUND OF THE INVENTION

When an AN polymer is heat-treated at high temperatures in the presence of a small amount of a non-solvent, the polymer and the non-solvent form a homogeneous fluid or melt, which exhibits fluidity like melts of polyesters and polyamides. Some methods for shaping the melt into fibers, etc. are known, for example, as proposed in U.S. Pat. No. 3,388,202, Japanese Patent Laid-Open Nos. 48-28982, 48-49839, 48-52832, etc. Many of these methods use water as the non-solvent for AN polymers and are characterized in that they give shaped articles of AN polymers without using any conventional expensive solvents such as dimethylsulfoxide, dimethylformamide, aqueous solutions of rhodanates, concentrated nitric acid, etc.

Methods of producing AN polymer melts at the same time of the polymerization of AN by applying the melting phenomenon of AN polymers to the polymerization system have been disclosed in Japanese Patent Laid-Open Nos. 50-97683, 54-30281, 54-23724, 54-93122, while Japanese Patent Laid-Open No. 51-101061 has proposed the use of AN monomer as the plasticizer for the polymers to enhance their plasticization. Given the situations, methods of using AN polymer melts for producing shaped articles such as shaped plastics, films, fibers, etc. have become considered to be favorable from the viewpoint of reducing and simplifying the production steps, reducing the production costs, saving energy, etc.

However, when the AN polymer melts as produced in accordance with the methods for producing them simultaneously with the polymerization of AN alone or a monomer mixture consisting essentially of AN (hereinafter referred to as "an AN monomer mixture"), such as those described in the above-mentioned patent publications, or in accordance with the method of using AN as the plasticizer that enhances the plasticization of AN polymers, such as that described in Japanese Patent Laid-Open No. 51-101061, are shaped into articles, the articles contain, immediately after the production thereof, the non-reacted monomer mixture consisting essentially of AN and even the AN monomer used as the plasticizer.

AN is toxic and must not be contained in final products. Therefore, AN must be completely removed prior to the final step of completing final products. For these reasons, the shaped AN polymer products are treated in water or hot water for many hours or are treated under reduced pressure, thereby removing AN therefrom. In addition, AN thus removed from the products must be completely recovered. Some equipment is required for the removal and recovery of AN, which, however, is problematic in that the producibility of the intended products is lowered and the costs for producing them are increased.

SUMMARY OF THE INVENTION

The object of the present invention is to provide a hot-melting AN polymer composition, which contains neither toxic AN monomer nor AN monomer mixture and therefore does not require the step of removing the toxic AN or mixture, as well as a method for producing the composition, and also provides a method for shaping the composition to easily obtain a monomer-free, shaped AN polymer article which does not require the step of removing such toxic AN or mixture from the shaped article.

We, the present inventors have assiduously studied a method for shaping a hot-melting AN polymer composition containing an AN monomer mixture. As a result, we have found that, when the AN monomer mixture existing in a hot-melting AN polymer composition comprising an AN polymer is converted into a non-volatile substance through chemical reaction, the resulting polymer composition shall contain no "monomer", and when the composition is shaped, the shaped article does not require the step of removing the AN monomer mixture therefrom. On the basis of these findings, we have completed the present invention.

Accordingly, the present invention provides a hotmelting AN polymer composition comprising:

(a) a non-volatile component as modified from an AN monomer mixture consisting of AN alone or consisting essentially of AN and containing, as the balance, at least one other polymerizable, ethylenically-unsaturated compound, by making the AN monomer mixture non-volatile through chemical reaction, (b) an AN polymer comprising AN units alone or 60% by weight or more AN units, and (c) water.

As one preferred embodiment of the invention, the chemical reaction is desirably Michael addition reaction.

The present invention also provides a method for producing a hot-melting AN polymer composition, which comprises melting a mixture comprising:

(d) an AN monomer mixture consisting of AN alone or consisting essentially of AN and containing, as the balance, at least one other polymerizable, ethylenically-unsaturated compound, (b) an AN polymer comprising AN units alone or 60% by weight or more AN units, and (c) water, followed by modifying the AN monomer mixture (d) in the resulting melt into a non-volatile component through chemical reaction.

As one preferred embodiment of the method of the invention, the chemical reaction is desirably Michael addition reaction.

The present invention further provides a method for producing a shaped article of AN polymer, comprising melting any one of the above-mentioned hot-melting AN polymer compositions under heat, followed by shaping the resulting melt.

The terminology "non-volatility" as referred to herein shall apply to substances having a boiling point of 200° C. at normal pressure and to those that do not boil.

According to the present invention, therefore, there are provided an AN polymer composition and a shaped article there of which contain neither toxic AN monomer nor AN monomer mixture, and also methods for producing the composition and the shaped article.

DETAILED DESCRIPTION OF THE INVENTION

The AN monomer mixture as referred to herein, which shall be converted into a non-volatile component through chemical reaction according to the present invention, indicates AN alone as well as a monomer mixture consisting essentially of AN and containing, as the balance, at least one other polymerizable, ethylenically-unsaturated compound. Concretely, the compound includes known unsaturated compounds capable of copolymerizing with AN, for example, vinyl halides and vinylidene halides such as vinyl chloride, vinyl bromide, vinyl fluoride, vinylidene chloride, etc.; unsaturated carboxylic acids such as acrylic acid, methacrylic acid, maleic acid, itaconic acid, etc., and salts thereof; acrylates such as methyl acrylate, ethyl acrylate, butyl acrylate, octyl acrylate, methoxyethyl acrylate, phenyl acrylate, cyclohexyl acrylate, etc.; methacrylates such as methyl methacrylate, ethyl methacrylate, butyl methacrylate, octyl methacrylate, phenyl methacrylate, cyclohexyl methacrylate, etc.; unsaturated ketones such as methyl vinyl ketone, phenyl vinyl ketone, methyl isobutenyl ketone, methyl isopropenyl ketone, etc.; vinyl esters such as vinyl formate, vinyl acetate, vinyl propionate, vinyl butyrate, vinyl benzoate, etc.; vinyl ethers such as methyl vinyl ether, ethyl vinyl ether, etc.; acrylamide and alkyl-substituted acrylamides; unsaturated sulfonic acids such as vinylsulfonic acid, allylsulfonic acid, methallylsulfonic acid, styrenesulfonic acid, etc., and salts thereof; styrene and alkyl- or halogen-substituted styrenes such as styrene, methylstyrene, chlorostyrene, etc.; allyl alcohol, and esters and ethers thereof; basic vinyl compounds such as vinylpyridine, vinylimidazole, dimethylaminoethyl methacrylate, etc.; unsaturated aldehydes such as acrolein, methacrolein, etc.; unsaturated nitriles such as methacrylonitrile, vinylidene cyanide, etc.; crosslinkable vinyl compounds such as glycidyl methacrylate, N-methylolacrylamide, hydroxyethyl methacrylate, divinylbenzene, ethylene glycol diacrylate, etc.;

The mixing ratio of the non-volatile component (a), the AN polymer (b) and water (c) that constitute the composition of the present invention is not specifically defined but may be freely selected, provided that these (a), (b) and (c) form the intended, hot-melting AN polymer composition of the invention. Desirably, however, the proportion of the AN polymer (b) is 50% by weight or more, that of water (c) is 40% by weight or less, and that of the non-volatile component (a) is 30% by weight or less.

The mixing ratio of the AN monomer mixture (d), the AN polymer (b) and water (c) is also not specifically defined but may be freely selected, provided that these (d), (b) and (c) form the intended, hot-melting AN polymer composition that shall be processed according to the present invention. Desirably, however, the proportion of the AN polymer (b) is 50% by weight or more, that of water (c) is 40% by weight or less, and that of the AN monomer mixture (d) is 30% by weight or less.

The chemical reaction to be employed in the present invention in order to convert the AN monomer mixture into a non-volatile component is not specifically defined. Any and every chemical reaction can be employed for the purpose, provided that it can be conducted in a mixture system comprising the mixture, an AN polymer consisting of AN units alone or consisting of at least 60% or more AN units and other units of at least one other ethylenically-unsaturated compound, and water and that it attains the intended modification of the mixture into a non-volatile component without having any chemical influence on the AN polymer itself.

Favorably, however, Michael addition reaction which utilizes the reactivity of AN is employed as the chemical reaction in order that the AN monomer which is the essential component in the AN monomer mixture is efficiently converted into a non-volatile substance through the reaction while the AN polymer is not influenced by the reaction. Such Michael addition reaction is effective and gives good results, through which many monomers easily copolymerizable with AN monomer react similarly like AN monomer.

As so mentioned hereinabove, the terminology "non-volatility" as referred to herein shall apply to substances having a boiling point of 200° C. or higher at normal pressure and to those that do not boil. For example, AN reacts with sodium sulfite to give sodium salt of sulfopropionitrile, which does not boil. Methyl acrylate that is popularly used in copolymerization reacts with sodium sulfite to give sodium salt of methyl sulfopropionate, which also does not boil. Since the thus-converted compounds are not toxic, unlike AN, they cause no problems even though they exist in final products.

Any and every reagent can be used in Michael addition reaction, provided that it is a nucleophilic compound which reacts with monomers to give non-volatile substances. Concretely, the reagent includes organic compounds having functional groups, such as alcohols, mercapto compounds, ethers, aldehydes, ketones, acid chlorides, carboxylic acids, esters, amides, primary, secondary, tertiary and quaternary amines, sulfides, etc., and anionic derivatives of such compounds as well as various anionic compounds; and even organic compounds such as oxides, thiolates, hydrides, cyanides, hydroxides, iodides, azides, chlorides, bromides, acetates, etc. In addition to these, also usable are inorganic substances, for example, alkali hydroxide compounds such as sodium, potassium and lithium hydroxides, etc., carbonates, alkaline inorganic salts, inorganic acids, etc.

Along with the above-mentioned reagents, usable are organic and inorganic basic compounds, such as various alkaline substances, alkali metals, hydroxyl compounds, carbonate compounds, Triton B, alkyl alkoxides, etc., as catalysts, without limitation.

A series of reactions, which is referred to as cyanoethylation, is known as one type of Michael addition reaction. Cyanoethylation is especially preferably applied to the modification of AN monomer into a non-volatile substance. Reagents usable in the reaction are referred to, for example, in Organic Reactions, Volume V. Concretely, they include water, alcohols, oximes, hydrogen sulfide, mercaptans, inorganic acids, prussic acid, haloforms, sulfones, nitro compounds, ketones, aldehydes, derivatives of malonic acid and cyanoacetic acid, allylacetonitrile, $\alpha,\beta$-unsaturated nitrites, cyclic dienes, organic peracids, ammonia, amides, sulfamic acid, tertiary alkanes, sulfinic acid, etc. Of these, especially preferred are sulfurous acid, alkali sulfites, alkali metabisulfites, alkali bisulfites, polyhydric alcohols, etc., in view of the costs, the degrees of reactivity and the reaction products.

The method of mixing the reagents which are used for the chemical modification of the AN monomer mixture into a non-volatile component according to the present invention is not specifically defined but may be selected from any known mixing means. As the case may be, the reagents are instantaneously completely mixed all at a time by the use of a pin-mixer or the like to give good results. The amounts of the reagents to be used for the chemical modification are not specifically defined, provided that the monomer component can be completely reacted with them. However, if the reagents used are harmful substances, it is unfavorable that they remain in the resulting AN polymer composition and the shaped article thereof. In this case, the molar amount of each reagent to be added shall be the same as that of the AN monomer mixture. On the other hand, if the reagents to be used are harmless, it is desirable to add an excess molar amount of each reagent over the AN monomer mixture.

The non-volatile component to be modified from the AN monomer mixture though chemical reaction according to the present invention is not specifically defined, provided that it does not give any harmful substance that may volatile or scatter from the shaped article to be formed from the AN polymer composition containing the non-volatile component. Practically, it is desirable that the AN monomer mixture is modified into compounds having a boiling point of 200° C. or higher at normal pressure or those that do not boil or, that is, those that decompose prior to boiling, as so mentioned hereinabove. Such compounds include oxydipropionitrile to be formed by the reaction with alkaline water, succinonitrile to be formed by the reaction with prussic acid, succinoimide to be formed by the reaction with sodium prussiate, alkoxypropionitriles to be formed by the reaction with alcohols, alkylperoxypropionitriles to be formed by the reaction with alkyl peroxides, thiopropionitrile to be formed by the reaction with hydrogen sulfide, alkylmercaptopropionitriles to be formed by the reaction with alkylmercaptans, iminodipropionitrile or tricyanoethylamine to be formed by the reaction with ammonia, alkylaminodipropionitriles to be formed by the reaction with alkylamines, acyliminodipropionitriles to be formed by the reaction with alkylamides, sulfopropionitrile and its sodium salt to be formed by the reaction with sulfurous acid or sodium sulfite, alkyl-substituted butyronitriles to be formed by the reaction with tertiary alkanes, alkylsulfonylpropionitriles to be formed by the reaction with alkylsulfinic acids, alkanesulfonyliminodipropionitriles to be formed by the reaction with alkylsulfamic acids. Of these, preferred are compounds having a large molecular weight and compounds having polar functional group(s) such as sulfonic acid group and the like that can be easily converted into non-volatile substances, for example, sodium sulfopropionitrile, alkanesulfonyliminodipropionitriles, alkylsulfonylpropionitriles, etc., and also alkoxypropionitriles to be formed by the reaction with polyhydric alcohols.

Regarding the form of the shaped articles of AN polymer of the present invention, they may be three-dimensional plastic blocks, two-dimensional films, one-dimensional fibers, etc. Conventional methods and devices can be directly employed to shape the AN polymer composition of the invention into shaped articles with desired forms. For example, to shape plastic blocks, employable are the techniques of compression molding, transfer molding, injection molding, extrusion molding, etc.; to shape films, employable are the techniques of calendering, T-die sheeting, inflation molding, etc.; and to spin fibers, employable are the techniques of semi-melt spinning, melt spinning, etc.

To carry out the present invention, the shaped films can be monoaxially or biaxially stretched and oriented, and the synthetic AN fibers as obtained through semi-melt spinning or melt spinning can be subjected to ordinary stretching, drying, heat relaxation, mechanical crimping, etc., without overstepping the spirit and the scope of the present invention.

The temperature at which the AN polymer composition of the invention is shaped is not specifically defined, provided that the composition is melted to give an AN polymer melt. From the practical viewpoint, however, if the temperature is too high, there is a probability that some unfavorable problems occur in that the shaped articles are colored or the AN polymer itself is modified through chemical reaction at too high temperatures. Therefore, the temperature is preferably 230° C. or lower, more preferably 190° C. or lower.

Additives to improve the properties of the AN polymer, for example, coloration-preventing agents, heat-resistant stabilizers, flame retardants, antistatic agents, ultraviolet stabilizers, pigments, foaming agents, etc., can be added to the AN polymer composition of the present invention, provided that the additives do not have any negative influences on the composition and on the shaped articles to be formed from it.

The present invention is described concretely by means of the following examples, which, however, are not intended to restrict the scope of the present invention. In the examples, parts and percentages are by weight, unless otherwise specifically indicated.

To determine the content of the AN monomer mixture consisting of AN alone or consisting essentially of AN as remained in the shaped samples produced hereinunder, the ambient gas around the samples was collected immediately after the shaping of the samples and subjected to gas chromatography to measure the concentration of the AN monomer in the gas. The shaped sample was dipped in hexane of 20 times as large as the volume of the sample and extracted therein for one day at room temperature. The concentration of the monomer component as extracted in hexane was measured. From the data thus measured, the concentration of the monomer component remaining in the shaped sample was quantitatively determined. The detectable limits are 0.5 ppm by volume and 0.5 ppm by weight.

EXAMPLE 1

One part of an initiator, di-tert-butyl peroxide was mixed with and dissolved in a monomer mixture comprising 90 parts of AN and 10 parts of methyl acrylate. Next, 88 parts of the monomer solution and 12 parts of water were fed into an autoclave and heated therein up to 120° C. at a rate of 2° C./min, while stirring under autogenous pressure, and the mixture was kept therein at the elevated temperature for 60 minutes, whereby it was polymerized to give an AN polymer melt. Next, 3 parts of sodium metabisulfite was added to the melt and reacted at 150° C. for 10 minutes, whereby the non-polymerized AN monomer mixture remaining in the melt was chemically modified into a non-volatile component. The thus-obtained melt composition was spun, through a spinneret hole having a diameter of 0.1 mm, into a spinning chimney filled with pressurized steam. As a result, any rapid vaporization of the non-reacted monomer did not occur and the spinning was continued stably. In the fiber thus spun, the formation of AN polymer having a viscosity average molecular weight of 57,800 was confirmed. After being stretched, the fiber had a size of 5.2 deniers and a strength of 3.8 g/d. Immediately after the spinning, the monomer content of the ambient gas around the fiber and the monomer concentration in the fiber were measured, which were below the detectable limits. There is no problem in the practical use of the fiber obtained herein.

EXAMPLE 2

12.8 parts of water and 4.0 parts of AN were added to 83.2 parts of AN polymer made from 88 parts of AN and 12 parts of methyl methacrylate and having a viscosity average molecular weight of 55,000. The resulting polymer-water-AN mixture was melted through a single-screw extruder at 128° C. to give a uniform melt, which was then continuously mixed with an aqueous solution of sodium metabisulfite and passed through a pin-mixer at 128° C. for a residence time of 2 minutes, whereby AN was converted into β-sulfopropionitrile. The pin-mixer was provided with a spinneret having 169 orifices each having a diameter of 120 μm, at its end. Thus, the melt was spun through the spinneret into a spinning chimney filled with pressurized steam, and the fiber thus spun was stretched into a stretched fiber having a size of 2.5 d. Any rapid vaporization of the non-reacted monomer did not occur during the spinning, and the spinning was continued stably. Immediately after the spinning, the monomer content of the ambient gas around the fiber and the monomer concentration in the fiber were measured, which were below the detectable limits. There is no problem in the practical use of the fiber obtained herein.

EXAMPLE 3

The same process as in Example 2 was repeated except that a die having a width of 20 mils and a length of 160 mils was fitted to the end of a pin-mixer, through which the melt was extruded at a rate of 5 m/min to obtain a film. The thickness of the film thus obtained was about 2 mils. Any rapid vaporization of the non-reacted monomer did not occur during the extrusion of the melt, and the extrusion was continued stably. Immediately after the formation of the film, the monomer content of the ambient gas around the film and the monomer concentration in the film were measured, which were below the detectable limits. There is no problem in the practical use of the film obtained herein.

EXAMPLE 4

An AN fiber having a size of 4.8 d was obtained in the same manner as in Example 1, except that benzenesulfinic acid was used in place of sodium metabisulfite. Also in this system, any rapid vaporization of the non-reacted monomer did not occur during the spinning, and the spinning was continued stably. Immediately after the spinning, the monomer content of the ambient gas around the fiber and the monomer concentration in the fiber were measured, which were below the detectable limits. There is no problem in the practical use of the fiber obtained herein.

EXAMPLE 5

An AN fiber having a size of 2.2 d was obtained in the same manner as in Example 2, except that pentaerythritol was used in place of sodium metabisulfite. Also in this system, any rapid vaporization of the non-reacted monomer did not occur during the spinning, and the spinning was continued stably. Immediately after the spinning, the monomer content of the ambient gas around the fiber and the monomer concentration in the fiber were measured, which were below the detectable limits. There is no problem in the practical use of the fiber obtained herein.

EXAMPLE 6

An AN film having a thickness of 2.5 mils was obtained in the same manner as in Example 3, except that benzenesulfonamide was used in place of sodium metabisulfite. Also in this system, any rapid vaporization of the non-reacted monomer did not occur during the extrusion of the melt, and the extrusion was continued stably. Immediately after the formation of the film, the monomer content of the ambient gas around the film and the monomer concentration in the film were measured, which were below the detectable limits. There is no problem in the practical use of the film obtained herein.

Comparative Example 1

The same process as in Example 1 was repeated to obtain a fiber, except that sodium metabisulfite was not added to the melt. However, the non-reacted monomer gave out an offensive odor during the spinning, which was problematic in the working environment. Immediately after the spinning, the monomer concentration in the ambient gas around the fiber was measured to be 23 ppm by volume and the monomer concentration in the fiber was measured to be 46 ppm by weight. Since the fiber obtained herein contained such a large amount of the harmful substance, it could not be put into practical use.

Comparative Example 2

The same process as in Example 5 was repeated to obtain a fiber, except that pentaerythritol was not added to the melt. However, the non-reacted monomer gave out an offensive odor during the spinning, which was problematic in the working environment. Immediately after the spinning, the monomer concentration in the ambient gas around the fiber was measured to be 82 ppm by volume and the monomer concentration in the fiber was measured to be 36 ppm by weight. Since the fiber obtained herein contained such a large amount of the harmful substance, it could not be put into practical use.

Comparative Example 3

The same process as in Example 6 was repeated to obtain a film, except that benzenesulfonamide was not added to the melt. However, the non-reacted monomer gave out an offensive odor during the extrusion of the melt, which was problematic in the working environment. Immediately after the extrusion, the monomer concentration in the ambient gas around the film formed was measured to be 66 ppm by volume and the monomer concentration in the film was measured to be 21 ppm by weight. Since the film obtained herein contained such a large amount of the harmful substance, it could not be put into practical use.

As has been described in detail hereinabove, the present invention provides a method of shaping a melt of an AN polymer composition, wherein the steps of preparing dopes and recovering the solvents used, which are indispensable for the conventional methods of producing shaped AN articles, may be omitted. Therefore, the method of the present invention is advantageous in point of the economical aspect and the operability. In addition, since the shaped articles as obtained according to the method of the present invention do not contain monomers, they are safe to the human body. Moreover, since the steps of removing and recovering the monomers, etc. may be omitted in the method of the present invention, the method can be much simplified to rapidly give shaped articles. Thus, the producibility of shaped articles is much improved by the present invention.

What is claimed is:

1. A method for producing a hot-melting AN polymer composition, which comprises melting a mixture comprising:

(a) a monomer component consisting of AN alone or consisting essentially of AN and containing, as the balance, at least one other polymerizable, ethylenically-unsaturated compound, (b) an AN polymer comprising AN units alone or 60% by weight or more AN units, and (c) water, to produce a uniform melt, followed by modifying the monomer component (d) in the melt into a non-volatile component through a Michael addition reaction;

wherein the non-volatile component has a boiling point of 200° C. or higher at normal pressure or does not boil.

* * * * *